US006767091B1

(12) United States Patent
Kornfeld

(10) Patent No.: US 6,767,091 B1
(45) Date of Patent: Jul. 27, 2004

(54) METHODS AND PROCESSES FOR THE TREATMENT OF DIGITALLY PRINTED MEDIA

(76) Inventor: Cary Dikel Kornfeld, 468 Sierra Vista #7, Mountain View, CA (US) 94043

( * ) Notice: Subject to any disclaimer, the term of this patent is extended or adjusted under 35 U.S.C. 154(b) by 0 days.

(21) Appl. No.: 10/248,270

(22) Filed: Jan. 3, 2003

(51) Int. Cl.[7] ..... B41J 2/01

(52) U.S. Cl. ..... 347/101; 347/102; 347/105

(58) Field of Search ..... 347/101, 102, 347/103, 104, 105, 106; 428/32.1

(56) References Cited

U.S. PATENT DOCUMENTS 6,557,991 B2 * 5/2003 Koitabashi et al. ..... 347/101

* cited by examiner

*Primary Examiner*—Stephen D. Meier
*Assistant Examiner*—Alfred Dudding

(57) ABSTRACT

The perceived quality of ink jet printed output is enhanced by a variety of methods of the present invention. A porous layer is first applied on a printed substrate, which includes deposited ink spots composed of colorants, as a coating to protect the printed images from damages. A reflow agent is then applied to the coated printed substrate for solubilizing the deposited ink, thereby the colorants can diffuse into adjacent regions in the upper part of the printed substrate and into the adjacent region of the matrix layer. The matrix layer controls the diffusion of the reflow agents,thus controls the diffusion of the selective colorants in the deposited ink.

35 Claims, 9 Drawing Sheets

6a

6b

6c

METHODS AND PROCESSES FOR THE TREATMENT OF DIGITALLY PRINTED MEDIA

BACKGROUND OF INVENTION

This invention relates generally to the treatment of the printed images from printing devices so as to improve their appearance. More particularly, it relates to the enhancement of color saturation, the protection of printed images from various types of damage and the extension of the lifetime of these images.

Digital printing involves the creation of graphical and textual material by means of depositing tiny spots of ink to a substrate. It differs from other forms of printing because the images are composed of well defined, uniformly placed spots of ink whose distribution and patterns are defined by the print engine rather than by photographic screens or monolithic type.

Ink jet printing is widely used for creating low cost, color printed output. Many aspects of the design, construction and operation of ink jet printers, and the chemical formulation of the inks used in these printers and also to the substrates upon which the printed image is created (e.g. coated papers, transparent materials for use in overhead projectors) have been taught in the prior art.

The quality of the output produced by ink Jet printers is limited by a number of factors related to the method used to produce it. There are a number of other printing technologies for producing color prints of higher perceived quality than ink jet, such as dye sublimation, thermal wax transfer and color xerography. Ink jet printed output is perceived to have reduced color intensity (a washed out appearance) because the ink must be carefully deposited so that adjacent pixels are distinct and separate. If not, then the inks will mix ("bleed") and the resulting image will appear muddy and of low resolution.

FIG. 2 shows a series of the steps of an ink-jet printing process of the prior art. Element 202 is a drop of ink shown both in flight and upon contact with substrate—204. Element 206 is this drop of ink "impinging" onto the substrate. As depicted the droplet begins to lose its spherical shape as it encounters substrate 204. Element 208—is the same drop of ink, now being incorporated/absorbed into the substrate forming a wet drop of ink thus forming a spot. Element 210 depicts the spot somewhat later in time after the liquid vehicle of the ink has been completely absorbed into substrate 204. Finally, element 212 represents the spot after the spot has dried and the colorant immobilized into and/or atop substrate 204.

Jaeger et al.'s article entitled "The influence of Ink/Media interactions on Copy Quality in Ink-Jet Printing", published in Proceedings of the SID, Vol. 25/1, 1984, provides a comprehensive overview of the influence of ink and paper choices on the color quality of ink-jet prints. They conclude that the quality of these prints is dependent on the rapid absorption of ink into the substrate and the ability of the colorant to be retained on or near the surface of the substrate. They observe that photographic quality images require high-resolution prints (higher number dots per inch-dpi) and that the ultimate resolution of these prints is dependent on minimizing the lateral migration of the ink drop in the substrate. Thus their effort and focus is to prevent, minimize and limit the ultimate size of each dot applied to the printed image.

A great deal of effort has been directed toward improvements in reducing ink drop size by specially treated substrates that quickly absorb the wet ink spots, fast drying inks as well as combinations of inks that employ a variety of physical and chemical phenomena to reduce or eliminate ink mixing.

Palmer et al.'s article entitled "ink and Media Development for the HP Paintjet Printer", published in Hewlett-Packard Journal, August 1988, discusses the complex interactions between ink, print head design, properties of different substrates and the differing requirements of different forms of printing (text versus graphics). Their objective is to carefully control the resulting dot size to meet the requirements of each type of printing and each type of substrate (e.g. opaque versus transparent, coated versus non-coated). They clearly demonstrate that many factors must be considered (e.g. thermal tolerance of the ink, clogging of print heads, absorption of ambient moisture into coated papers thus making them tacky to the touch, etc.) when designing an Ink-jet printing system in which the dot size is carefully controlled to meet a variety of printing requirements.

Yoldas' article entitled "A dense transparent ink-jet receptive film that provides instantaneous print drying", published in Journal of Material Research Vol. 14, No. 6, June 1999, focuses on the development of coatings for Ink-jet substrates that lead to a tighter containment of colorants resulting in higher edge acuity for deposited ink drops thus enabling high resolution images. Yoldas describes a family of Sol-Gel coatings that quickly absorb and immobilize the large volume of water used as the vehicle for colorant in ink-jet inks.

All of these teachings share the common objective of producing the smallest resulting ink dot on the printed substrate and the prevention of colorant migration and unintended mixing of different inks.

The undesired mixing of wet ink spots is generally called "bleeding". One side effect of efforts to prevent bleeding is to deposit well-defined and separated ink spots. The substrate is not fully covered with ink and the underlying color of the substrate is seen. If that substrate is a white sheet of paper, then light scattered by the substrate itself increases the sense of the colors seeming to be "washed out".

A variety of methods have been suggested to overcome these limitations. These include making multiple printing passes over the substrate and depositing ink in patterns that overlap. Such methods require that the ink deposited on the first pass is sufficiently dry such that subsequent deposition of inks of other colors does not mix with the ink spots already deposited. Or it requires that specialized inks are used that are mutually immiscible so that colorants do not mix. These methods also require that more pixels are printed. Such methods increase the resolution of the image, but require a substantial increase (e.g. quadratic) in the number pixels to be printed. This requires the use of more ink, requires significantly longer printing times and because of very heavy ink loading, can cause the substrate material to wrinkle because of excess moisture.

U.S. Pat. No. 6,090,749 for Kowalski issued on Jul. 18, 2000 discloses a method for creating vivid and water-fast printed images on a specially designed multi-layer substrate. Kowalski requires the substrate be composed of two transparent layers: a hydrophilic, ink absorbing front layer and a hydrophobic backing layer. Kowalski also requires that the surface of the substrate is not covered or coated with any additional materials or layers. An ink jet printer is used to apply a highly specialized set of inks. These require use of "sublimable dye diffusion thermal transfer coloring agent". An ink jet printer is used to apply these inks onto an ink-absorbent hydrophilic front layer. The composite substrate is subsequently subjected to high temperature (and pressure) in order to vaporize the dye and to cause transference of colorant into a transparent hydrophobic backing layer. The transference of colorants into the interior of the backing layer is described as occurring by absorption, capillary action and alternatively termed diffused into the interior of the backing layer.

The objective of the Kowalski process is to produce a water-fast, vivid color image. These objectives impose a number of requirements and restrictions. For example, in order to assure that the resulting image is water-fast, all of the colorant initially deposited on the ink-absorbing layer must be transferred from the water absorbing front layer into the interior of the water resistant backing layer. Since all of the colorant must be removed from the first layer to the second layer, the transference of colorant cannot be color dependent.

The objective of creating a "vivid" color image requires that lateral diffusion of colorant be restricted and ideally would not occur. Kowalski's methods imposes similar restrictions on the initial application of inks as is necessary for simpler ink-Jet printing processes and then imposes additional requirements in the form of specially designed multi-layer substrates, specially designed inks and additional processes all of which are necessary to vaporize the colorants so as to transfer them into a transparent, water resistant backing layer.

There is a need, therefore, for methods for enhancing the perceived quality of the printed images and protecting the printed images from various types of damage.

OBJECTS AND ADVANTAGES

Accordingly, an object of this invention is to provide methods for enhancing the perceived quality of ink jet printed output by a controlled and selective diffusion of the colorant in the deposited inks, and the encapsulation of the printed material so as to protect it from various types of damage (e.g., water spotting, bleaching of colorant).

It is a further object of the present invention to transform the well-defined spots into diffused, somewhat larger regions of color. Ideally, each pixel is transformed into a gaussian, graded distribution of colorant in which the center region of the deposited ink spot is of uniform color, but decreases in color intensity at the margins of the transformed pixel, which results in increased color intensity, reduced white light scattering off of the substrate and a more photographic, continuous tone appearance of the resulting printed output.

It is an additional object of the invention to provide encapsulation of the printed substrate with a protective coating that inhibits subsequent water spotting, smearing or other damage to the printed image as caused by water or moisture. The encapsulating and resulting protective layer can also provide additional benefit such as the reduction of static charge accumulation, UV blockage, glare reduction, and can act as a barrier to gaseous and liquid agents. The encapsulation of the printed image lengthens the lifetime of the image by protecting the image from color aging as caused by the bleaching of the colorant by chemical and radiation mechanisms.

It is another object of the present invention to provide methods for decreasing the printed resolution of images without loss of perceived image quality, thus reducing the amount of ink used, accelerating the speed of printing and reducing the time required for the print to dry.

Further objects and advantages of this invention will become apparent from a consideration of the drawings and ensuing description.

SUMMARY OF INVENTION

The perceived quality of the pixilated printed output including a printed substrate and a spot of ink composed of colorants deposited and absorbed into the top surface of the substrate is enhanced by methods of the present invention. A porous or matrix layer is first applied as a coating on a top surface of the printed substrate. The matrix layer is partially absorbed into the substrate. A reflow agent is then applied to the coated substrate for solubilizing the colorants of the deposited ink so that the colorants diffuses into adjacent regions in the upper part of the printed surface of the substrate and/or into the porous coating. The matrix layer is semi-permeable to the variety of the reflow solvents, and is impermeable to the deposited ink.

The reflow agent can be applied on top of the matrix layer in a liquid form in an amount such that the colorants will not diffuse out of the matrix layer. Alternatively, the reflow agent can be applied in a vapor form, which diffuses and condenses into the matrix layer and the printed substrate.

The reflow agent also can be applied from a bottom surface of the substrate and in a liquid form. In this case, the matrix layer needs not be semi-permeable to the reflow agent.

Alternatively, the reflow agent can be applied into the matrix layer prior to applying the matrix layer on top surface of the substrate. The reflow agent can be mechanically mixed into the matrix layer as a sol/gel solution or as an adhesive coating of a tape. The reflow agent also can be microencapsulated in the matrix layer and is released from the matrix layer after the matrix layer is deposited on the top surface of the substrate, which leaves vacuoles in the matrix layer.

The reflow agent may be selected to non-black colorants only, thus it does not solubilize the black colorant.

The diffusion of colorants is terminated by either evaporating or solidifying the reflow agent, thus the matrix layer acts as a coating of the printed substrate for protection against damage and aging.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

This invention intends to enhance the appearance of pixilated printed output by the controlled enlargement of the ink spots used to form pixels. This enlargement can occur within the print substrate or in the encapsulating layers or both.

The word "pixel" is a well-understood term used by those skilled in the art that makes reference to a single picture element. Pixels or picture elements represent a single component used to create symbols, images and other elements of a digitally encoded image. Color images are composed of pixels each of which is comprised of one or more spots of ink, typically of different colors. The aggregate of these represent a single picture element or pixel.

Figure 1:
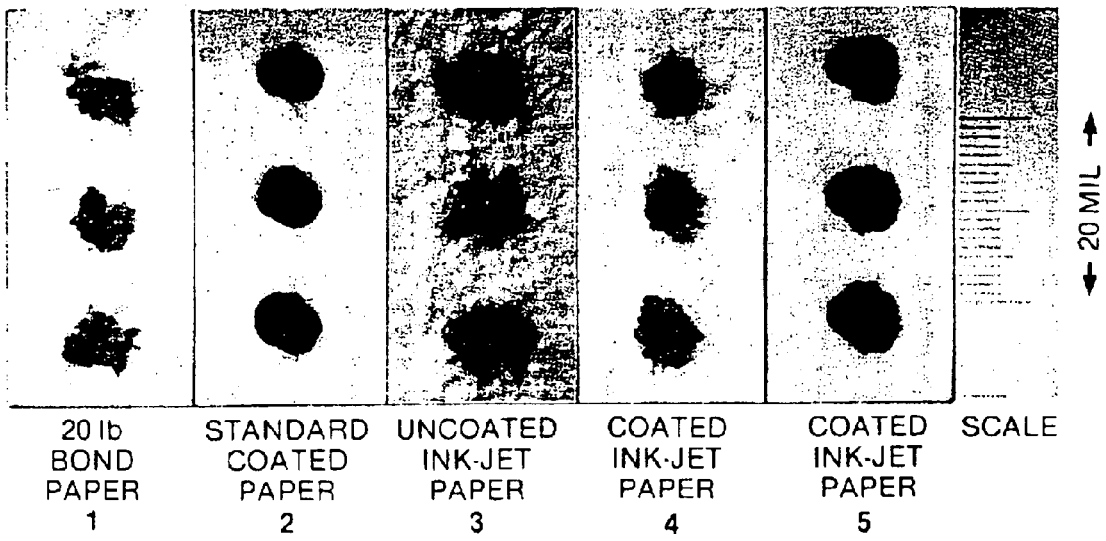
FIG. 1 shows six microscopic images of ink drops on various paper samples comparing drop shape, retention and lateral spread.

FIG. 1 shows five microscopic images of ink spots (pixels) on various paper samples. FIG. 1 also provides a measure for estimating the actual size of typical ink-jet pixels on paper substrates.

Figure 2:
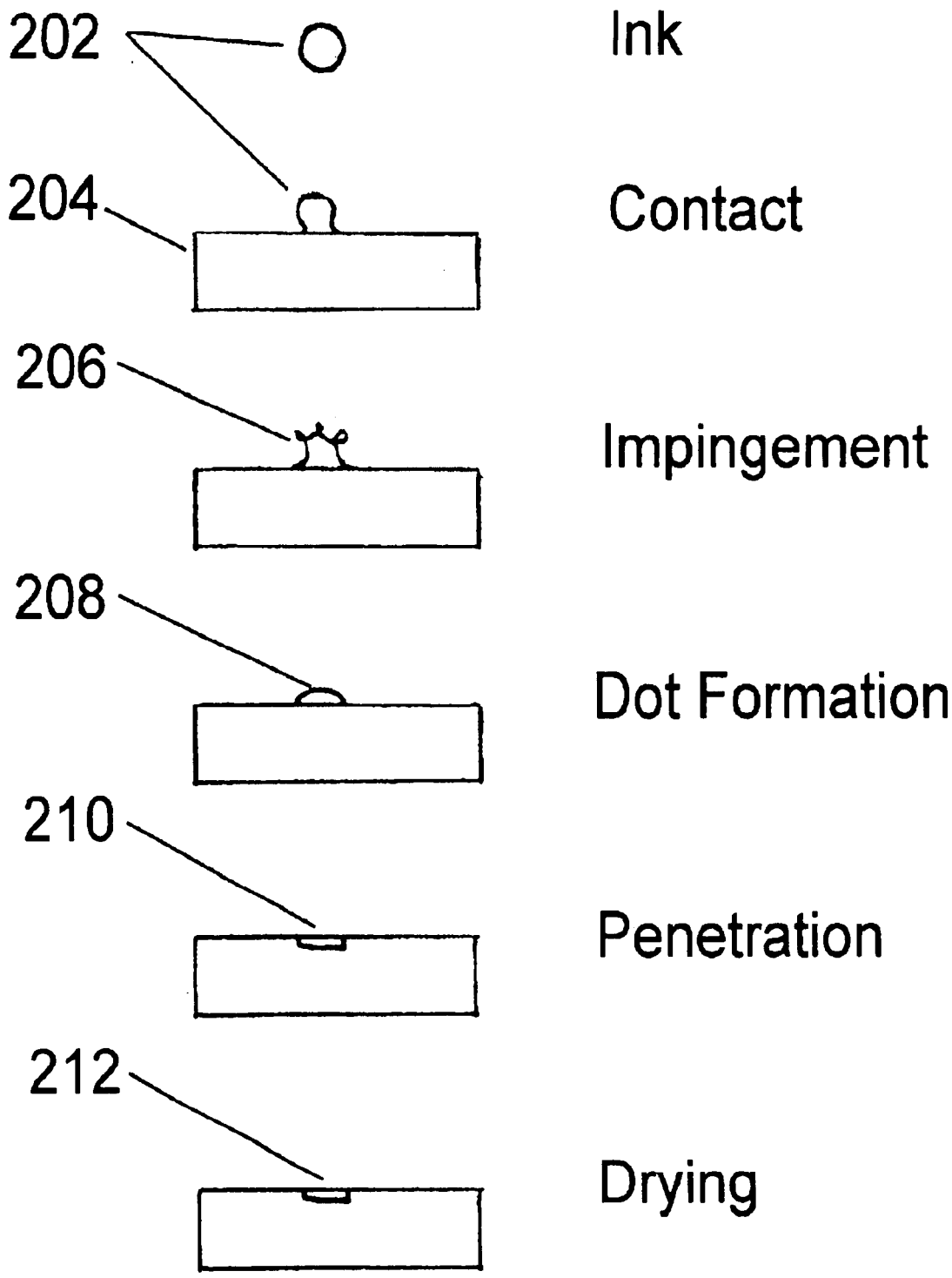
Fig. 2 (Prior Art)
FIG. 2 depicts a process of applying a drop of ink to a substrate of the prior art.

The methods enumerated in this patent are described in terms of the modification and enhancement of the individual spots of ink that comprise the pixels or picture elements of printed output. It is assumed that the image has thoroughly dried and each pixel would be consistent with element 212 in FIG. 2.

Before treatment by the processes described in this patent, it is assumed that each pixel is well defined and spatially separated from one another. The microscopic appearance of each pixel exhibits a somewhat circular spot of ink of more or less uniform intensity against a background of the substrate used to create the printed output. The edges of these spots are generally well defined and when viewed as a collection of pixels creates a pointillist image.

Figure 3:
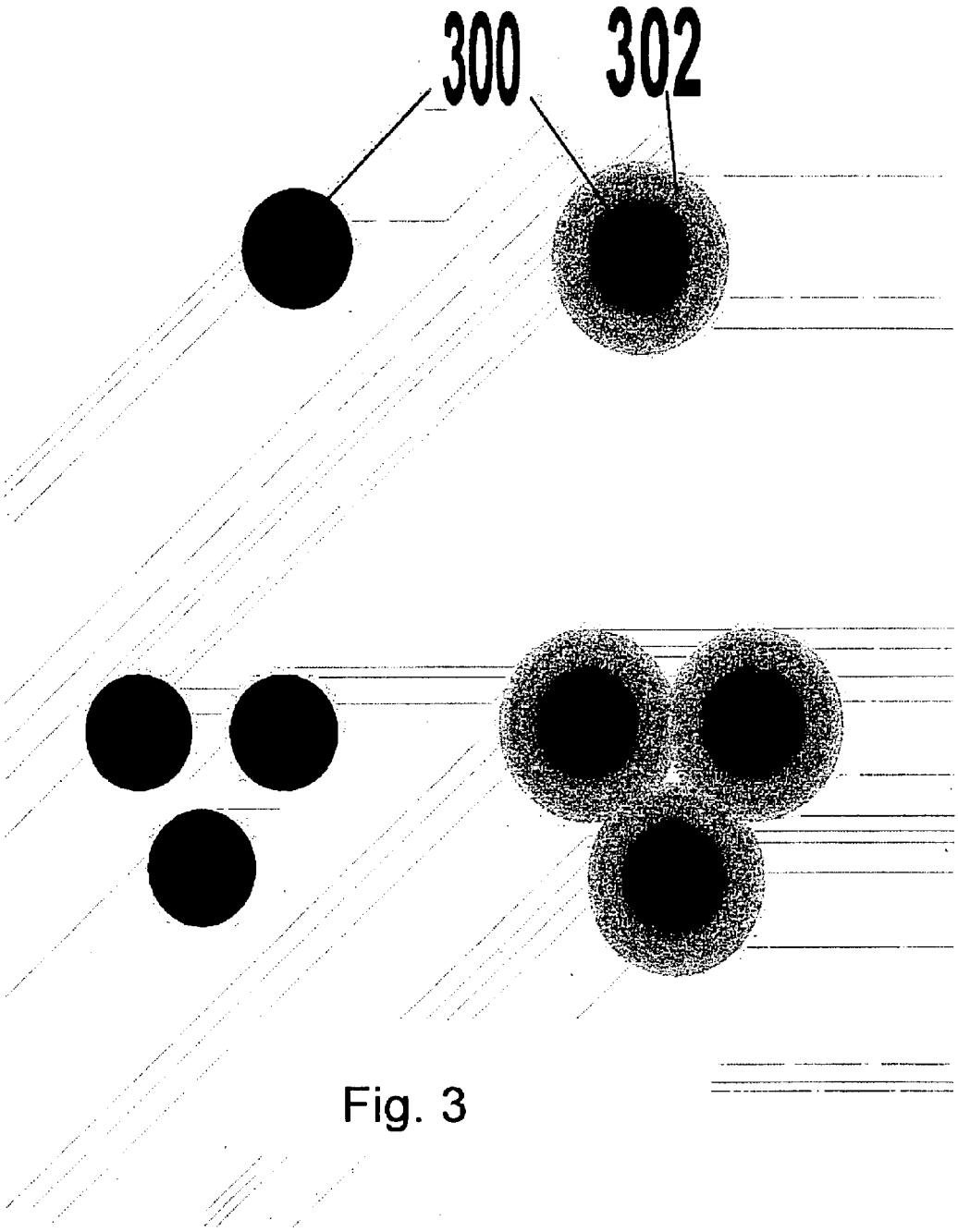
FIG. 3 is a top view of enhanced and unenhanced pixels and pixel groupings.

FIG. 3 shows a microscopic top view of two ink spots 300 and their cluster of three pixels before and after enhancement by the various methods described in this patent. The enlargement in the size of the ink spot is depicted by region 302, which surrounds the original ink spot 300. Those on the left represent untreated pixels whereas those on the right represent the same pixels after enhancement.

A number of methods for achieving the desired transformation of pixilated printed output are described using the particular method known as ink jet printing as examples. Each method depicts the process of enlargement applied to a single spot of ink. Ink jet prints are used to illustrate, but as is readily apparent to one skilled in the art, these methods can be applied to any pixilated printed output. The chemical agents employed will vary according to the chemical properties of each type of printing and are chosen by virtue of their interaction with the colorants, carriers and substrates used in the printing process.

Method 1

Figure 4:
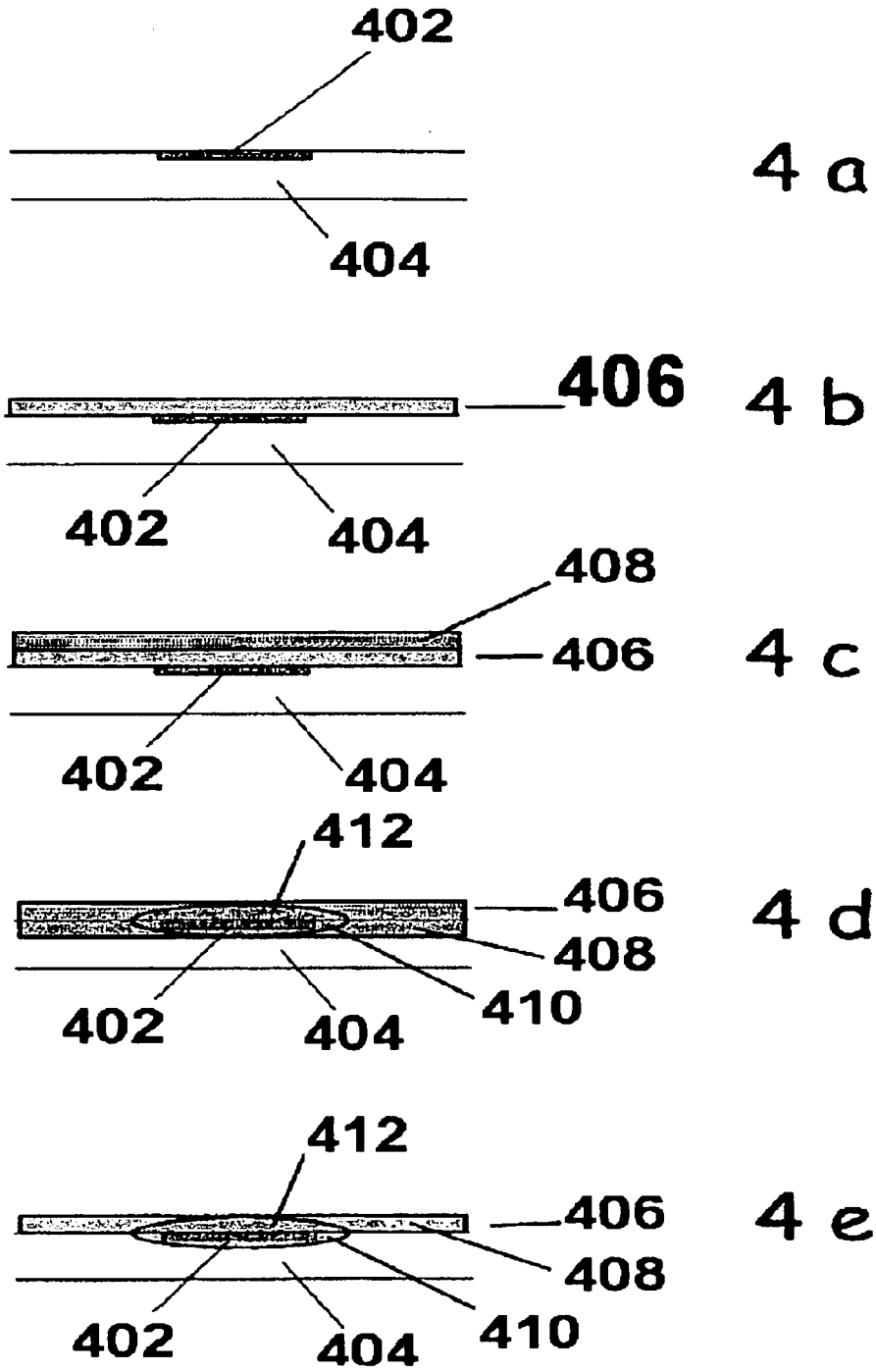
FIGS. 4*a–e* is a sequence of side views depicting a series of the step of Method 1.

This method is described in FIGS. 4*a*–4*e*. The original pixilated printed output is composed of a plurality of ink spots. FIG. 4*a* shows a side view of a single ink spot 402 composed of a colorant and is embedded into the surface of substrate 404.

FIG. 4*b* shows a subsequent application of a transparent matrix layer 406 (for example, an acrylic polymer or Aluminum alkoxide AIO(OH)) that does not interact with the deposited colorant but creates a porous layer capable of being infused with a second material. The matrix layer 406 is deposited as a coating. The matrix coating is selected so as to be partially absorbed into the substrate such that the surface region of the substrate is now coated. The matrix coating 406 is further selected such that it is semipermeable to a variety of solvents that will solubilize the colorants used in the printed image. Ideally, the matrix coating 406 will include a plurality of linked chambers or vacuoles, thus resembling a transparent sponge that is subsequently saturated with a "reflow agent".

FIG. 4*c* shows the same region after the application of a "reflow agent" 408 to matrix layer 406 such that the colorant is induced to diffuse through the matrix. The structure of the matrix limits the flow of a solvent or "reflow agent", thus controls and limits the diffusion of colorant. Again, think of a transparent sponge-like solid (a matrix) filled with a clear fluid in which the colorant has limited solubility. The ensemble, sponge and solvent, are clear, and the diffusion of the colorant is restricted by the porosity of the sponge or matrix.

The selection of solvent is dependent on the composition of the colorant. Experimental studies using a variety of different ink jet printers indicate that such colorant will generally respond to a semi-polar aqueous reflow agent such as aqueous solutions of low molecular weight alcohols (e.g. 90% isopropyl alcohol).

The binder component of Latex Paint may be used as a reflow agent. Krylon "Living Color" Clear Latex Enamel is widely available.

Latex paint typically consists of Microscopic Titanium Oxide particles, a fluid material, called binder, in which colorant is readily soluble, and a colorant. The binder solidifies leaving behind a surface of titanium oxide with a colorant infused throughout. Krylon Clear Latex Enamel is merely the binder without colorant or titanium oxide.

It should be noted that the use of simple latex binder provides all of the virtues of ordinary house paint. The binder includes Ultraviolet (UV) light blocks so that the colorant is not bleached in sustained direct sun light. Ordinary house paint does not wash away despite fairly heavy rain. Finally, house paint provides an effective barrier against weather to painted houses, preserving color intensity and protecting the exterior covering of the house.

The porosity of the matrix can be controlled by a variety of mechanisms. For example, if the matrix material is applied as an aerosol, the spray of the aerosol can be directed upward in an arch in which the matrix material cascades downward onto the printed surface. The cascade of material allows the production of small particulate clusters of the matrix material which when applied to the substrate results in a loosely packed surface layer and thus provides porosity to the matrix layer. The porosity of the matrix will control the diffusion of colorant.

An acrylic plastic (e.g. Krylon Brand Crystal Clear Acrylic spray coating or Aervoe Clear Acrylic spray coating) is an example of a semi-permeable, sponge-like matrix layer suitable for the purposes of this invention.

A number of other techniques, well known to one skilled in the art, can be employed to create a sponge like matrix coatings of one or more other materials.

The quantity and method of application of the reflow agent is controlled such that only a limited amount of reflow agent is applied. FIG. 4*d* shows the same region shortly after application of the reflow agent. As shown, reflow agent 408 penetrates into the matrix layer 406 and may also penetrate into the topmost region of substrate—404

As shown in FIG. 4*d*, reflow agent 408 interacts with colorant spot 402 resulting in a limited diffusion of colorant into regions adjacent to the colorant spots. These include subsurface diffusion as depicted by region 410, resulting in a small enlargement of the original colorant spot. It also includes region 412 defining the extent of colorant diffusion into matrix layer 406. Region 412 results in a "blooming" of colorant as it is drawn into the encapsulated matrix 406. Region 410, the subsurface diffusion component, results in a graded area of colorant intensity resulting in a softened edge to the original dot 402.

Furthermore, the reflow agent 408 must be applied in limited quantities such that a pooling of reflow agent does not form on top of the matrix layer 406. This is controlled so that the colorant does not diffuse out of the matrix layer resulting in a broader spreading of colorants and a lack of control of the diffusion process caused by the unrestricted flow properties of the reflow agent. If not controlled, the wide diffusion of the inks will degrade the resulting appearance of the image. It has been found that application via aerosol, sponge or blotter can provide the required level of control, although it would be obvious to one skilled in the art to use other well known methods for application of coatings onto to surfaces could be employed.

FIG. 4*d* shows the complete absorption of the reflow agent into and through the matrix layer, creating a penetration zone which consists of the upper part of substrate 404 saturated with reflow agent 408.

The region depicted as 410 in FIG. 4*d* represent the subsurface diffusion of colorant surrounding the original ink spot 402. Region 412 represents the diffusion of colorant into the matrix layer by reflow agent 408.

The amount of diffusion can be controlled by a variety of factors. These can be used to control the resulting size of the transformed pixels. Such control can be achieved by use of selected "reflow agents" which have differing colorant solubilities, by varying the amount of reflow agent applied to the substrate and by controlling the duration during which the reflow agent can interact with the underlying pixels, and finally by controlling the solidification of the reflow agent by means of evaporation and/or polymerization.

FIG. 4*e* represents the same region after drying. Reflow agent 408 has partially evaporated leaving a residual coating on the surface of substrate 404.

In an ideal realization of Method 1, reflow agent 408 would be selected to physically and/or chemically interact with the matrix layer so as to create a protective, impermeable composite coating. Alternatively, one or more additional coatings could be applied that are impenetrable to water, solvents and would provide whatever additional properties maybe desired (e.g. anti-static, non-glare, UV or IR blocks).

Method 2

In this method a matrix coating is applied to the front side of the printed image, and a reflow agent is subsequently applied from the back side of the substrate and saturates the substrate.

In this method the matrix layer need not be semi-permeable to the reflow agent. The barrier layer in this embodiment completely prevents the problem of surface bleeding and confines all mixing of colorant to subsurface diffusion. At the margin between the substrate and matrix layer, colorant will diffuse outward and produce the desired softening and slight enlargement of the pixel size.

Figure 5:
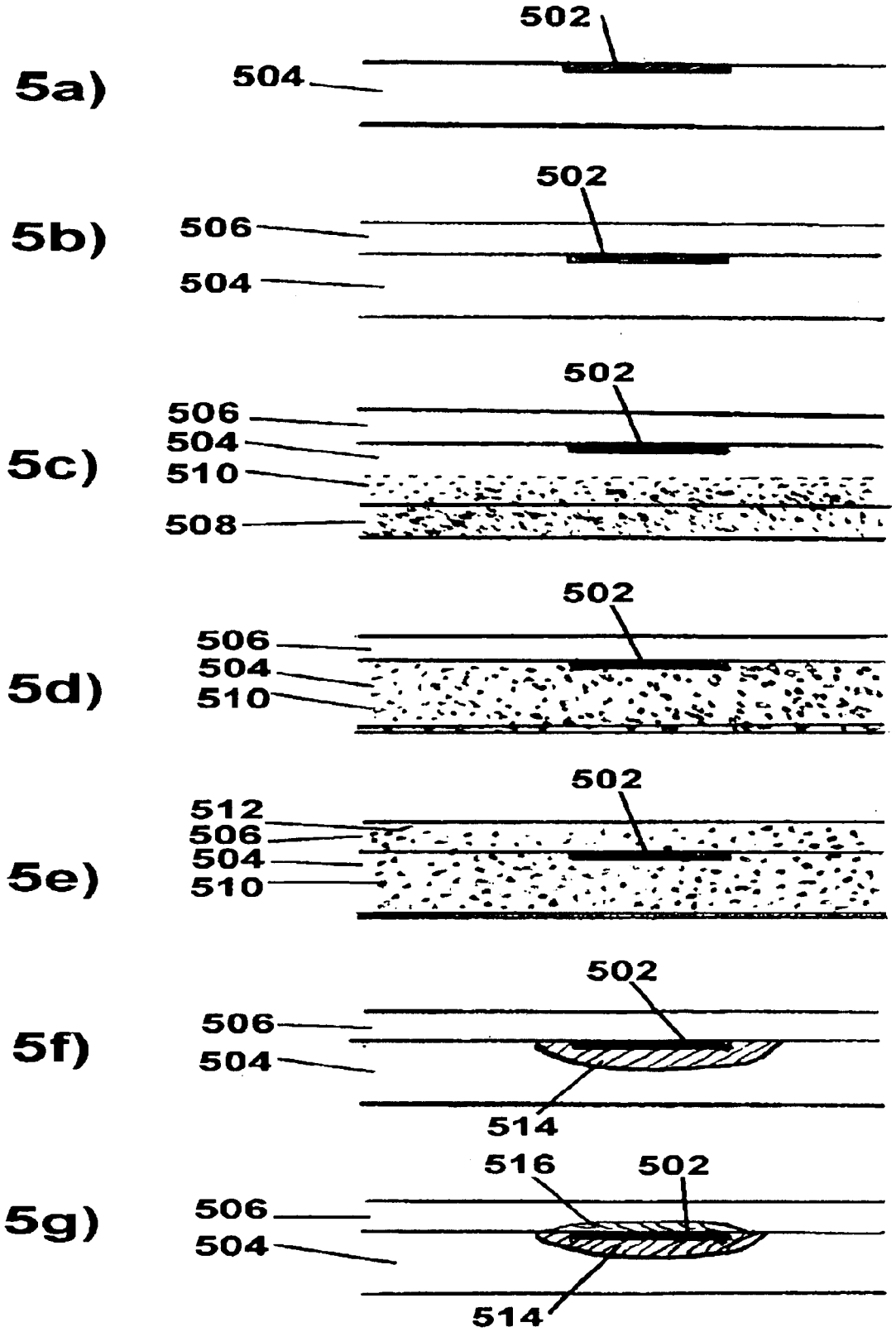
FIGS. 5*a–g* is a sequence of side views depicting a series of the steps of Method 2.

FIGS. 5*a*–5*g* show the various steps used in Method 2. FIG. 5*a* shows a side view of the initial condition of a single colorant spot 502 printed onto substrate 504. As shown, the colorant is portrayed as penetrating into the substrate although the depth or extend of penetration can vary widely.

FIG. 5*b* shows the same region after application of matrix layer 506. The porosity of matrix layer 506 can vary considerably. The layer can be impermeable, semi-permeable or absorbing of a reflow agent.

FIG. 5*c* shows the same region after application of a reflow agent 508. As shown, this reflow agent penetrates into substrate 504 forming region 510.

FIG. 5*d* shows the same region a short time later. Reflow agent 508 fully penetrates into substrate 504.

FIG. 5*e* depicts the case in which matrix layer 506 is either semi-permeable or absorptive of reflow agent 508. Region 512 depicts the penetration of the matrix layer by the reflow agent.

FIG. 5*f* is an alternate depiction of FIG. 5*e* in which matrix layer 506 is impermeable to reflow agent 508. Region 514 depicts the subsurface diffusion of colorant from region 502 into the surround region of substrate 504.

FIG. 5*g* shows the same region of FIG. 5*e* after the solidification and/or evaporation of reflow agent 508. Region 514 is the extent of subsurface colorant diffusion into substrate 504. Region 516 depicts the diffusion of colorant into matrix layer 506.

Method 3

In this method, a coating consisting of both matrix material and reflow agent is applied on the printed surface. As is well known is the art, a "sol/gel" coating consisting of a mixture of solid and fluid materials can be created. This mixture can consist of a matrix forming material mixed into a fluid capable of partially solubilizing the colorants used in printing.

Figure 6:
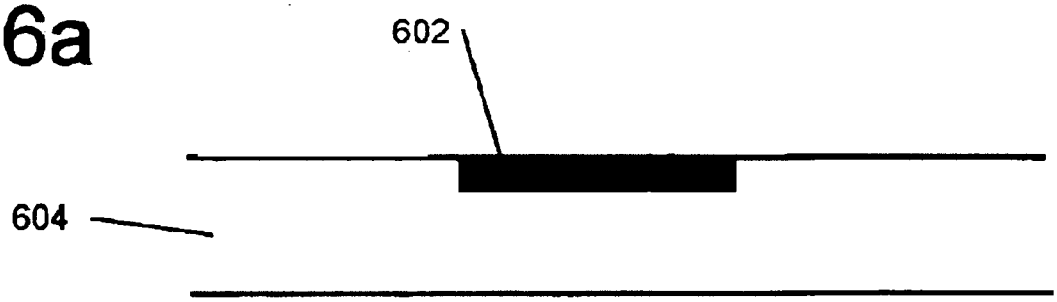
FIGS. 6*a–c* is a sequence of side views depicting a series of the steps of Method 3.
Figure 6:
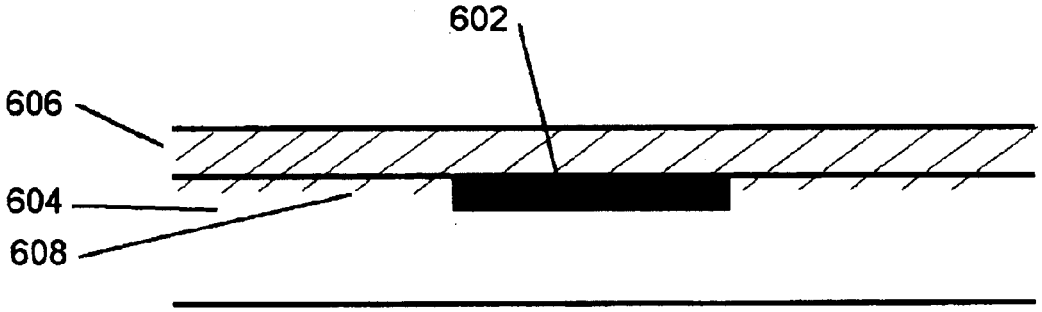
Figure 6:
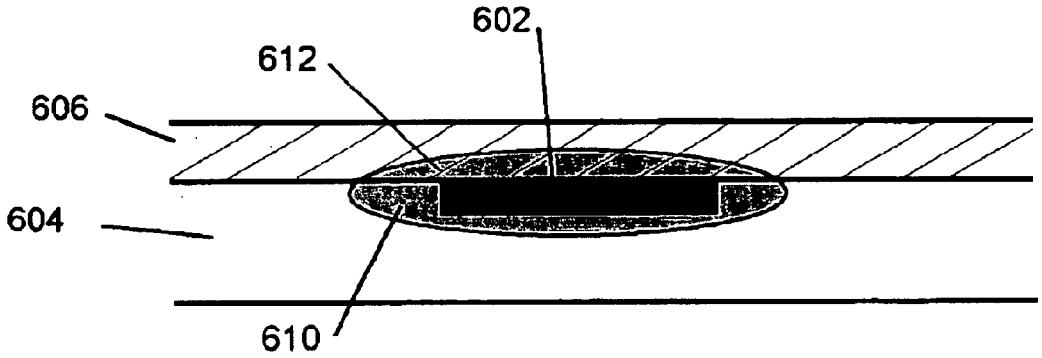

FIG. 6*a* is a side view of a small portion of a printed image consisting of a single colorant spot 602 deposited on substrate 604. As shown, the colorant spot 602 is penetrating a finite depth into the substrate 604. The depth of penetration is variable and does not significantly change the process described in this method.

FIG. 6*b* shows the same region after application of a sol/gel coating 606 to the printed surface of substrate 604. As is shown, region 608 depicts a small surface region of the substrate into which some of the fluid component of the sol/gel coating has penetrated.

FIG. 6*c* shows the same region after some period of time has elapsed. As is shown, some of the colorant has diffused into adjoining regions of original spot 602.

Region 610 depicts subsurface diffusion of colorant whereas region 612 defines the region of colorant diffusion into the sol/gel coating.

Method 4

The reflow agent can be microencapsulated and as such applied a a sheet or as a single coating. The microencapsulated reflow agent is released by any mechanism. The microencapsulated containment material provides a matrix like context that can be designed to provide limited diffusion of colorants.

Treatment by application of a microencapsulated coating onto the printed output can be further controlled by application of pressure, temperature and/or light onto the coating. Since the viscosity of the reflow agent is determined by temperature and pressure, application of such to the reflow agent can cause localized transformations in the agent causing partial or complete evacuation either into the printed substrate, into the air or both. Furthermore, since it is well known that polymeric dispersions can be further polymerized by action of photonic stimulation, this material can be converted into a solid polymer by application of light at selected frequencies. Such methods can also be used to control and limit ink diffusion. Finally, excess reflow agent can be removed by application of vacuum, thus creating a solid coating on top of and partially integrated into the printed substrate.

Figure 7:
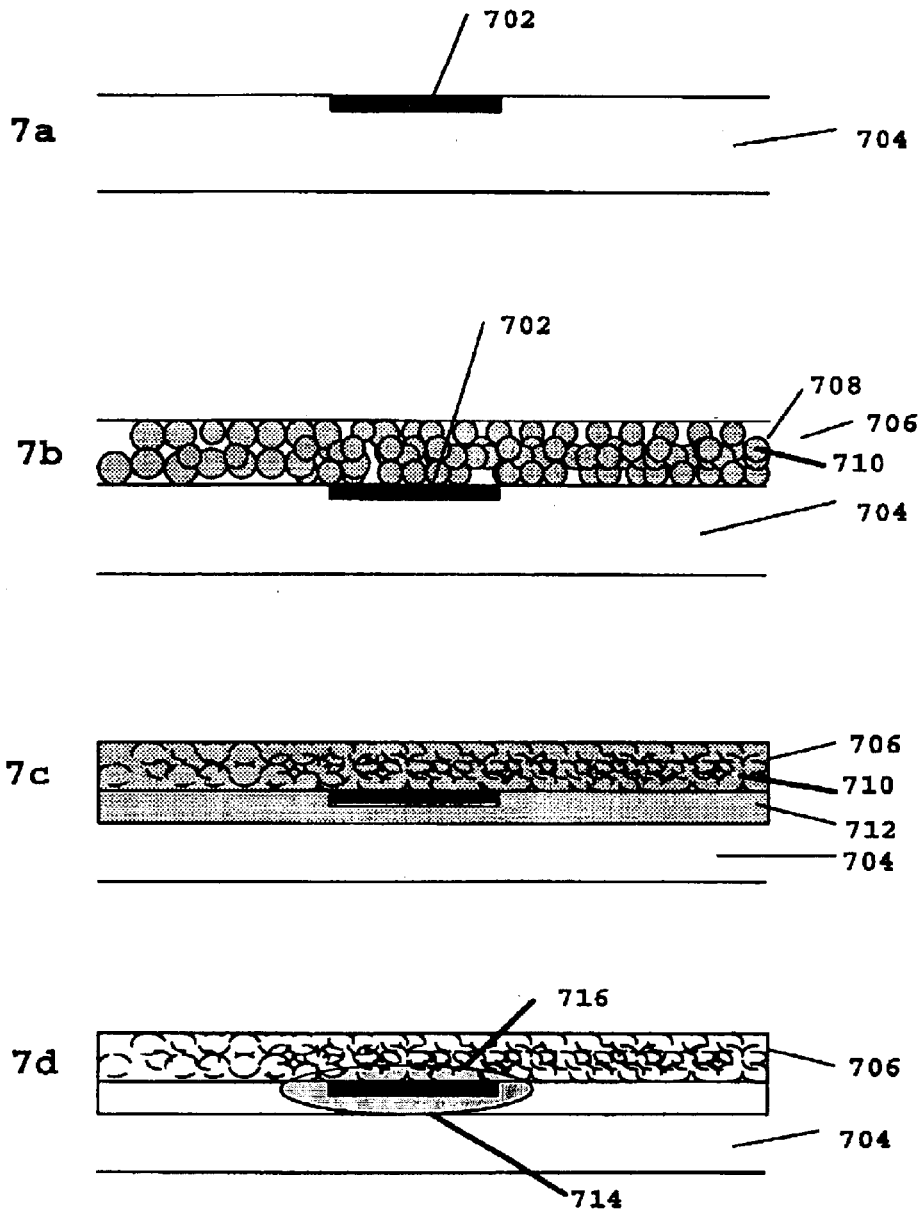
FIGS. 7*a–d* is a sequence of side views depicting a series of steps of Method 4.

FIG. 7*a* is a side view of a small portion of a colorant dot 702 printed onto substrate 704. FIG. 7*b* shows the same region after application of microencapsulated material 706 composed of microspheres 708 filled with reflow agent 710. FIG. 7*c* shows the same region after the microspheres 708 have been ruptured releasing reflow agent 710. The reflow agent is capable of limited penetration into substrate 704 as shown as region 712. FIG. 7*d* shows the same region after controlled and limited diffusion of colorant from dot 702 into surround regions. Subsurface diffusion is shown as region 714 whereas diffusion into the microencapsulated layer 706 is shown as region 716.

Method 5

This method differs from Method 1 by use of a vapor composed of reflow agent applied to the matrix layer. This vapor is allowed to condense and thus fill the matrix layer with reflow agent. The reflow agent is then capable of limited penetration into the substrate and finally allowing limited diffusion of colorant into surrounding regions.

Figure 8:
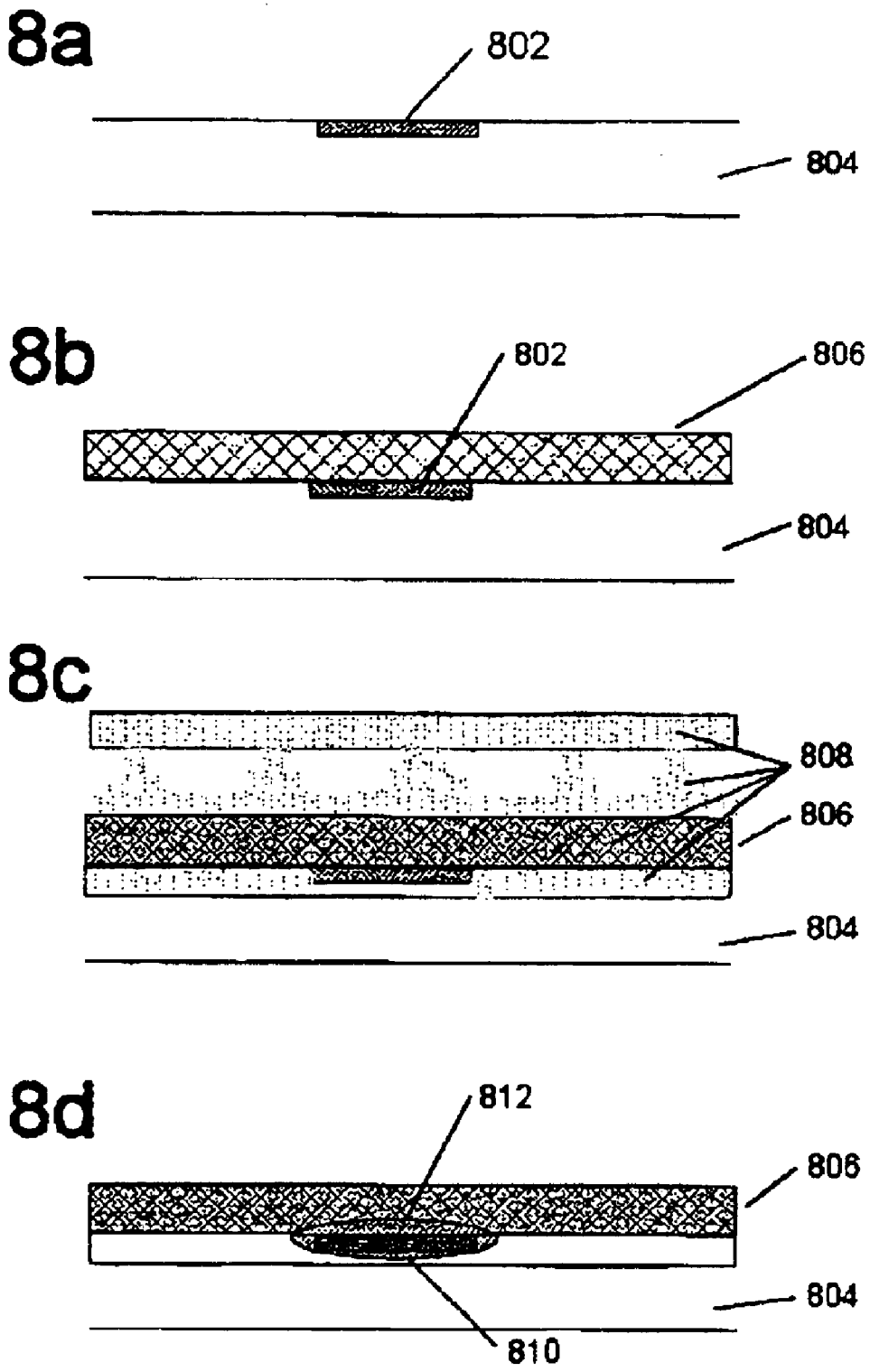
FIGS. 8*a–d* is a sequence of side views depicting a series of the steps of Method 5.

FIG. 8*a* is a side view of a small portion of a colorant dot 802 printed onto substrate 804. FIG. 8*b* shows the same area after application of a matrix layer 806. FIG. 8*c* shows the infiltration of matrix layer 806 with a vaporous reflow agent 808, allowed to condense within matrix layer 806 and then limited penetration into substrate 804.

FIG. 8*d* shows the same area after diffusion of colorant from dot 802 into surrounding regions. Region 810 depicts substrate diffusion whereas region 812 shows diffusion of colorant into matrix layer 806.

Method 6

An adhesive tape can be used to provide a delivery mechanism for the reflow agent. The adhesive coating of the tape can be reformulated to incorporate the reflow agent. For example, the reflow agent can be applied to an existing adhesive coating and then mechanically mixed into the adhesive. When the tape is applied to the printed surface, diffusion of colorant occurs. Additional control can be attained by first coating the print with a matrix layer.

Figure 9:
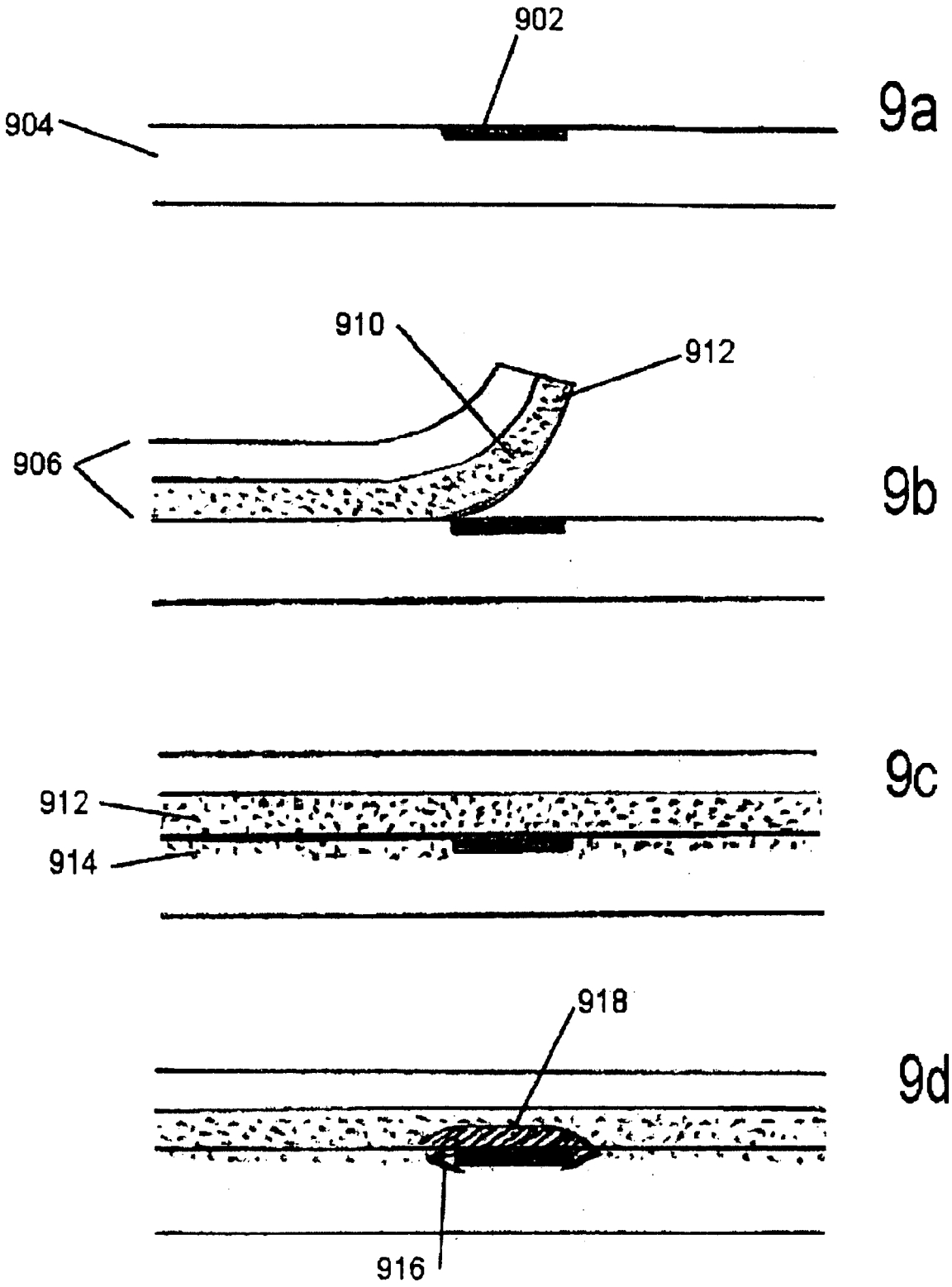
FIGS. 9*a–d* is a sequence of side views depicting a series of the steps of Method 6.

FIG. 9*a* is a side view of a small portion of a colorant dot 902 printed onto substrate 904. FIG. 9*b* shows the application of adhesive tape 906 consisting of a polymeric layer 908 coated with an adhesive 910 in which reflow agent 912 is admixed.

FIG. 9*c* shows the same area after the adhesive tape has been applied to the surface of the printed substrate. Reflow agent 912 is depicted as having limited penetration into substrate 904 in region 914. FIG. 9*d* sows the same area a short time later. Colorant from dot 902 diffuses into subsurface region 916 and into adhesive layer 910 as shown as region 918.

Method 7

A transparent film consisting of a phase change reflow agent can be applied to the printed surface of the substrate. A zone or localized phase change process (e.g. thermal, photonic) is used to convert a localized region from solid to liquid form. This provides a localized region in which colorant dispersal occurs. The film can be further enhanced with a modulating agent (e.g. Aluminum alkoxide IO(OH) can be embedded. Such agent provides additional means to limit the dispersion of colorant by the reflow agent. The reflow agent reverts to solid form by means of cooling or polymerization or other means.

All described methods are employed in order to limit the amount of colorant diffusion within the printed substrate and into one of several types of the overlying coatings. All of these methods are capable of controlling and limiting the diffusion of colorant for the purpose of enhancement of perceived image quality, color saturation and also protection of these printed images from abrasion, water damage, gaseous oxidation and fading of colorant by exposure to high energy ultra-violet light.

Selective ink Dispersion:

It is well understood that visual acuity of the human eye varies according to the frequency (color or hue) of light perceived. This phenomenon is employed in other imaging systems like television that decouples the luminance and chromance portions of the image. Generally, the luminance portion of the image is encoded at a much higher sampling frequency (resolution) than is the chromance portion of the image. The trade off in bandwidth between luminance and chromance has been designed to produce a higher quality image than would be attained if the image were encoded equally.

It is the objective of the current invention to employ similar principles in the preferred embodiment of this invention. This is achieved by selecting a reflow agent that is selective to color inks only. That is, when possible, a reflow agent should be chosen that does not solubilize the blank colorant spots, but is selective to only the non-black colorants. IT is fortunate that many commercially available ink jet systems employ a variety of inks and intentionally use a fast drying black ink whose properties differ from the color inks. Selective transformation of only the colored pixel spots produces an image with high definition and increased color intensity. Since the black spots remain well defined, the equivalent luminance part of the image remains unchanged, whereas the colored spots diffuse softly though the substrate. Since the amount of diffusion can be controlled by a number of processes, the resulting image can be transformed such that the underlying substrate is completely covered with a coating in which colorants are softly diffused. This further reduces the perception of a "washed out" image caused by scattering of light by the substrate itself. The resulting image is nearly photographic in the sense that colored regions flow continuously into one another. The additional constraint that the black colorant not be transformed preserves the sharpness and detail of the image.

What is claimed is:

1. A method of modifying the perceived quality of a printed image by processes that results in the movement of a portion of the printing ink colorant into the volume surrounding each pixel, said volume includes the area beside, beneath and/or above said pixel.

2. The method of claim 1 in which the colorants of each pixel moves a distance of one pixel or less.

3. The method of claim 1 in which a subset of colorants of each pixel moves into the volume surrounding each pixel, said volume includes the area beside, beneath and/or above said pixel, said volume includes the area beside, beneath and/or above said pixel.

4. The method of claim 1 in which a subset of colorants of each pixel moves a distance of one pixel or less.

5. A method of modifying the perceived quality of a printed image by causing movement of a portion of the printing ink colorant into the space surrounding each pixel by means of:

a) applying a coating onto a printed surface of the substrate, the coating comprising a matrix layer that can be permeable, b) applying a reflow agent to the substrate for solubilizing the ink, whereby the colorant diffuses into an adjacent region in an upper part of the substrate, and c) arresting the diffusion of the colorant into the adjacent region.

6. The method of claim 5, wherein the colorant further diffuses into an adjacent region in the matrix coating.

7. The method of claim 5, further comprising arresting the diffusion of the colorant, thereby the coating forms a protective coating for the substrate.

8. The method of claim 5, wherein the reflow agent is transformed into a form in which colorant solubility is restricted.

9. The method of claim 8, wherein the reflow agent fully or partially evaporates.

10. The method of claim 8, wherein the reflow agent is composed of a polymeric dispersion in a liquid vehicle that evaporates.

11. The method of claim 8, wherein reflow agent is polymerized.

12. The method of claim 8, wherein reflow agent solidifies.

13. The method of claim 8, wherein the reflow agent chemically interacts with the colorant.

14. The method of claim 5, wherein the reflow agent is applied on top of the matrix coating.

15. The method of claim 14, wherein the reflow agent is applied in a liquid form.

16. The method of claim 14, wherein the reflow agent is applied in a vapor form.

17. The method of claim 14, wherein the reflow agent diffuses and condenses into the substrate.

18. The method of claim 5, wherein the reflow agent is applied to the non-coated surface of the substrate.

19. The method of claim 18, wherein the reflow agent is applied in a liquid form.

20. The method of claim 18, wherein the reflow agent is applied in a vapor form.

21. A method for treating a printed image including a substrate with a spot of ink, the ink being absorbed into a printed surface of the substrate, the ink comprising one or more colorants, the method comprising:

a) applying a coating on the printed surface of the substrate, the coating comprising a reflow agent for solubilizing the ink, whereby the colorant diffuses into an adjacent region in an upper part of the substrate, and b) arresting the diffusion of the colorant into the adjacent region.

22. The method of claim 21, wherein the colorant further diffuses into an adjacent region in the coating.

23. The method of claim 21, further comprising terminating the diffusion of the colorant, thereby the coating forms a protective coating for the substrate.

24. The method of claim 23, wherein the reflow agent is transformed into a form in which colorant solubility is restricted.

25. The method of claim 24, wherein the reflow agent is evaporated.

26. The method of claim 24, wherein reflow agent is polymerized.

27. The method of claim 24, wherein the reflow agent chemically interacts with the colorant.

28. A method for treating a printed image including a substrate with a spot of ink, the ink being absorbed into a surface of the substrate, the ink comprising one or more colorants, the method comprising:

a) applying a coating on the printed surface of the substrate, wherein the coating comprising a matrix forming material mixed with a reflow agent in a gel form, reflow agent for solubilizing the ink, whereby the colorant diffuses into an adjacent region in an upper part of the substrate and/or matrix coating, and b) arresting the diffusion of the colorant into the adjacent region.

29. A method for treating a printed image including a substrate with a spot of ink, the ink being absorbed onto a surface of the substrate, the ink comprising one or more colorants, the method comprising:

a) applying a coating on the printed surface of the substrate, wherein the coating comprises a microencapsulating containment material encapsulating the reflow agent, reflow agent for solubilizing the ink, whereby the colorant diffuses into an adjacent region in an upper part of the substrate and/or matrix coating, and b) arresting the diffusion of the colorant into the adjacent region.

30. The method of claim 29 further comprising applying a physical condition on the coating for causing localized transformations in the reflow agent so that the reflow agent is released from the coating.

31. The method of claim 3, wherein the physical condition comprises temperature.

32. The method of claim 30 wherein the physical condition comprises pressure.

33. The method of claim 30 wherein the physical condition comprises photonic stimulation.

34. A method for treating a printed image including a substrate with a spot of ink, the ink being absorbed onto a surface of the substrate, the ink comprising one or more colorants, the method comprising:

a) applying a coating on the printed surface of the substrate, wherein the coating comprises an adhesive tape in which the reflow agent is combined into the adhesive coating, reflow agent for solubilizing he ink, whereby the colorant diffuses into an adjacent region in an upper part of the substrate and/or adhesive coating, and b) arresting the diffusion of the colorant into the adjacent region.

35. A method for treating a printed image including a substrate with a spot of ink, the ink being absorbed onto a surface of the substrate, the ink comprising one or more colorants, the method comprising:

a) applying a coating on the printed surface of the substrate, wherein the coating comprises a mixture of a matrix material and a phase changeable reflow agent, and b) transforming the reflow agent into a liquid form for solubilizing the ink, whereby the colorant diffuses into an adjacent region in an upper part of the substrate and/or matrix coating, and c) arresting the diffusion of the colorant into the adjacent region by transforming the liquid form of the reflow agent into a solid form.

* * * * *